US008534168B2

(12) United States Patent
Marks et al.

(10) Patent No.: US 8,534,168 B2
(45) Date of Patent: Sep. 17, 2013

(54) COMPACT ADJUSTABLE LOCKING PLIERS

(76) Inventors: Joel S. Marks, Sherman Oaks, CA (US); Paul Janson, Northridge, CA (US)

( * ) Notice: Subject to any disclaimer, the term of this patent is extended or adjusted under 35 U.S.C. 154(b) by 422 days.

(21) Appl. No.: 12/929,907

(22) Filed: Feb. 24, 2011

(65) Prior Publication Data

US 2012/0216657 A1 Aug. 30, 2012

(51) Int. Cl.
*B25B 7/00* (2006.01)
*B25B 7/12* (2006.01)
*B25B 7/04* (2006.01)

(52) U.S. Cl.
USPC ..... 81/367; 81/368; 81/355; 81/390; 81/385; 81/300

(58) Field of Classification Search
USPC ..... 81/367, 368, 355, 390, 385, 300
See application file for complete search history.

(56) References Cited

U.S. PATENT DOCUMENTS

| | | | |
|---|---|---|---|
| 1,541,248 | A | 6/1925 | Carlson |
| 1,763,527 | A | 6/1930 | Jones |
| 2,066,716 | A | 1/1937 | Cruickshank |
| 2,114,180 | A | 4/1938 | Guba |
| 2,206,251 | A | 7/1940 | Fischer |
| 2,320,303 | A | 5/1943 | Ross |
| 2,399,454 | A | 4/1946 | Snell |
| 2,514,130 | A | 7/1950 | Jones |
| 2,519,630 | A | 8/1950 | Boyer |
| 3,104,571 | A | 9/1963 | Trybus |
| 3,262,343 | A | 7/1966 | Weller |
| 3,981,209 | A | 9/1976 | Caroff |
| 4,296,655 | A | 10/1981 | Tesoro |
| 4,651,598 | A | 3/1987 | Warheit |
| 4,773,288 | A | 9/1988 | Jang |
| 4,802,390 | A | 2/1989 | Warheit |
| 4,893,530 | A | 1/1990 | Warheit |
| 5,022,290 | A | 6/1991 | Duffy |
| 5,456,144 | A | 10/1995 | Dahl |
| 5,528,965 | A | 6/1996 | Finn |
| 5,746,099 | A | 5/1998 | Janson |
| 5,904,078 | A | 5/1999 | Gustafson |
| 5,941,142 | A | 8/1999 | Janson |
| 6,012,361 | A | 1/2000 | Wooster |
| 6,065,376 | A | 5/2000 | Khachatoorian |
| 6,116,124 | A | 9/2000 | Ping |
| 6,227,080 | B1 | 5/2001 | Grayo |

(Continued)

FOREIGN PATENT DOCUMENTS

| | | |
|---|---|---|
| FR | 1100105 | 9/1955 |

OTHER PUBLICATIONS

Photographs of Facom plier models 500 and 509.

*Primary Examiner* — Monica Carter
*Assistant Examiner* — Danny Hong

(57) ABSTRACT

A pliers is adjustable between at least two distinct selectable size ranges. A movable pivot pin is held stable in a selected recess of a slot in both loaded and unloaded conditions. A lower jaw is adjustable between a small and a large size range. A multifunction spring is movably attached to a body to both firmly bias a lower jaw and handle to an open position and to retain the pin in a constant selected pivot position of the body for normally used conditions. The pliers include a familiar function and compact shape without additional bulk from the structures of the improved features. Only a simple wire form is required to provide the improvement of the invention in a preferred locking pliers embodiment.

25 Claims, 4 Drawing Sheets

(56) References Cited

U.S. PATENT DOCUMENTS

| | | | | |
|---|---|---|---|---|
| 6,578,452 | B2 | 6/2003 | Duffy | |
| 6,708,588 | B2 | 3/2004 | Kesinger | |
| 7,086,312 | B1 | 8/2006 | Tortolani | |
| 7,182,004 | B1 | 2/2007 | Wang | |
| 7,313,989 | B1 | 1/2008 | Tortolani | |
| 7,444,851 | B1 | 11/2008 | Janson | |
| 7,730,810 | B1 * | 6/2010 | Janson | 81/367 |
| 7,861,622 | B2 | 1/2011 | Chervenak | |
| 8,056,451 | B2 * | 11/2011 | Chervenak et al. | 81/367 |
| 2005/0279195 | A1 * | 12/2005 | Hile | 81/368 |
| 2010/0018363 | A1 * | 1/2010 | Chervenak et al. | 81/324 |
| 2010/0192734 | A1 * | 8/2010 | Engvall et al. | 81/319 |

* cited by examiner

COMPACT ADJUSTABLE LOCKING PLIERS

FIELD OF THE INVENTION

The present invention relates to an adjustable locking pliers. More precisely the present invention relates to a simplified compact structure for such locking pliers.

BACKGROUND

Locking pliers are well known in the art. One such conventional device is known as a Vise Grip pliers. These devices have two jaws that may be locked on an object. The over-center locking mechanism is achieved through a fixed jaw attached to a body, a movable jaw pivoted to the body, a handle pivoted to the movable jaw, and a pivoting over-center link between the body and movable jaw that together cooperate to lock the jaws on a work piece when the handle is forced toward the body. The over-center mechanism includes a fine adjustment screw that controls the opening of the jaws over a limited range to accommodate articles of different sizes within the range and permits the over-center mechanism to lock.

Another common variation is known as adjustable and water pump pliers. These allow for a movable pivot location to adjust the jaw size range for a given handle position. Further locking pliers have been combined with an adjusting mechanism to provide an adjustable locking pliers. In this manner a locking pliers can maintain a relatively parallel jaw and fit a wider size range of objects to be gripped. Some designs, for example "auto adjusting" types require careful and unintuitive manipulation of handles of the pliers to adjust or maintain a jaw size.

However the prior attempts to combine locking and size range adjusting features have a required a bulky, inconvenient, or inefficient mechanism. One example is a pliers according to U.S. Pat. No. 3,981,209; a corresponding product is sold by Facom of France as model #509. Another related Facom product is model #500 which includes features of the '209 patent along with features from French patent 1,100,105. These models are not easily adjusted and have a limp handle wherein there is no opening bias upon the lower jaw or the handle to stabilize the tool in a hand. Further without an opening bias there is no feedback for the position of the handle. All of the prior such designs have been awkward in appearance or use. According to the present invention a locking adjustable pliers includes a familiar appearance in a simple and compact design.

SUMMARY OF THE INVENTION

In the present invention a locking pliers includes a lower jaw that pivots about an upper body. The upper body preferably includes a fixed upper jaw at a front end. The pivot location between the lower jaw and upper body is movable between at least two distinct positions to enable at least two jaw opening ranges. For example in a small size range the pliers may be operated to lock the lower jaw in a minimum size to clamp directly against the upper jaw with a zero gap. The large size range has the lower jaw usually or always spaced away from the upper jaw.

According to the above description the jaw spacing may be changed in two ways. A continuous respective motion of the lower jaw occurs as the pliers are normally operated by moving a lever or handle pivotally attached to the lower jaw. This motion normally changes the respective angle of the jaws. A second type of motion is moving the jaws between the distinct small and large size ranges. Optionally more than two distinct pivot positions may be provided.

According a preferred embodiment of the invention a slot through the body extends generally vertically in the body or substantially perpendicular to the upper jaw face. A pin, protrusion, or equivalent structure of the lower jaw moves within this slot to allow the lower jaw to move toward and away from the upper jaw. The pin is fixed or located on the lower jaw. The pin preferably extends beyond the body to be exposed and operable directly by a user. A preferably enlarged head end provides a large gripping surface for such operation. A preferred embodiment further includes a recess or locally wide portion in the slot into which the pin is selectively held. A recess corresponds to each pivot position of the jaws. In the above example therefore with two jaw pivot positions there would be two recesses or sets of recesses. Optionally the pin may be located on the upper jaw while the lower jaw is moved in relation to the upper jaw. In this case the slot may be within or upon the lower jaw.

One feature of the invention is a compact spring assembly to provide both a reliable detent bias and a firm rotational bias to a lower jaw. The pin is spring biased in the detent action into the recess but not normally mechanically locked in position. A user operates directly on the pin to move it out of the recess and along the slot. As discussed in detail below normal gripping or clamping with the pliers adds further biasing force to retain the pin in the recess. In this manner no further locking elements are needed to securely position the pin although such features may optionally be added if desired. Therefore the pivot position may be adjusted without secondary releasing steps. Further the adjustment process is immediate and intuitive since moving the pin directly moves the lower jaw in the preferred embodiment. This contrasts with some known designs where a handle or other indirectly related element must be manipulated before the jaw size can be adjusted. With the lower jaw also biased by the spring assembly to rotate away from the upper jaw the handle is biased away from the body as a user holds the tool in its pre-locking condition about a work piece. The pliers thereby gives feedback for the handle position as the handle moves within the hand grip before it is locked.

In the illustrated embodiment the features of the invention are provided in a familiar locking pliers configuration. It is an object of the invention that the design be familiar whereby the additional features and functions of the invention are readily understood and usable while adding no or minimal additional bulk to the device. In contrast many prior pliers are complex in appearance and in fact without even offering the new advantages of the present invention. It is a feature of the invention that the new function is provided with the addition of only a simple wire formed part and optionally a washer to the known locking pliers device. A novel way to attach and link simple components provides an unexpected result of the invention. Other novel but visually simple features are included in the structure of the invention. The pliers of the invention can therefore be manufactured inexpensively and without great investment in tooling.

Alternately it may be desired to incorporate the features of the invention into a pliers or clamping device that is of other familiar or less familiar forms. The jaws may be of various forms. In the illustrated embodiment the jaws are a straight serrated style for demonstrative purposes. Other known jaw configurations for example are smooth, needle nose, concave, or c-clamp style. Other jaw configurations are anticipated as usable with the pliers of the invention. In one example if the jaw adjusting motion is sufficiently large the device may take more the form of a bar clamp rather than a pliers. In this example a slot or recess may extend along a bar to selectively fit the pivot pin described herein. Or for example the invention may be used in a pliers that more resembles a water pump pliers type configuration. Preferably but not exclusively the pliers of the invention is a locking type, although a non-locking type will also benefit from the present invention. For example a pliers without the over-center action would be a non-locking type.

DETAILED DESCRIPTION OF THE PREFERRED EMBODIMENTS

Figure 1:
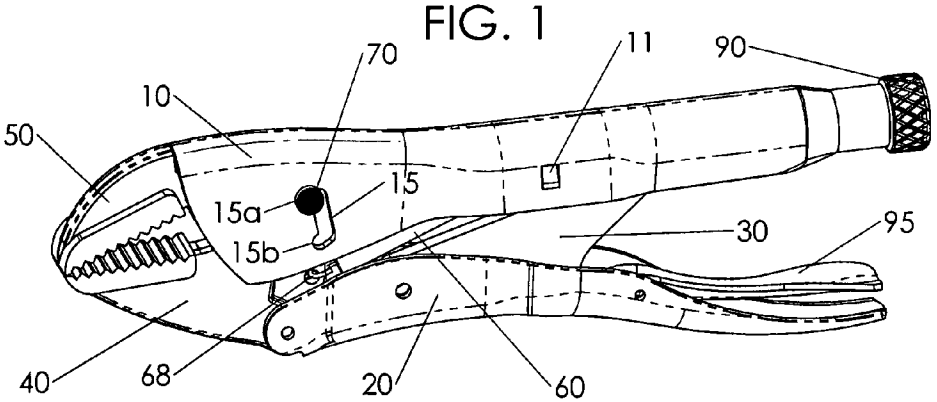
FIG. 1 is a left, top perspective view of a preferred embodiment pliers, according to the present invention, in a minimum size jaw angle.

FIG. 1 shows an external view of a preferred embodiment of the invention. In the views most of the pivoting links are shown as simple through holes. Normally there are rivets or pins to create respective linkages at these holes. These rivets or pins are not shown for simplicity with the exception of pin 70. The pliers are preferably but not necessarily of a locking type including an over center mechanism of known type. In this mechanism handle 20 cooperates with linkage 30 to lock lower jaw 40 upon an object or work piece against upper jaw 50. Upper jaw 50 is normally attached to or part of body 10. Lower jaw includes grip surface 43 while upper jaw 50 includes grip surface 51. Handle 20 and linkage 30 are arranged to provide a leveraged action wherein, near the closed position of handle 20, a relatively large motion of the handle causes a small motion of jaw 40. The advantages of the invention will benefit a leveraged type pliers with or without a locking function. End 32 of linkage 30 presses tip 92 of screw 91. In this manner high gripping forces are possible. In the illustrated embodiment the grip surfaces are straight serrated style. Other shapes or types of grip surfaces are anticipated including concave, smooth, c-clamp style, wire cutter and other types that may be useful as clamping or gripping surfaces.

Knob 90 enables rotation of screw 91, threads not shown, within a threaded opening of body 10. Lower jaw 40 rotates about pin 70 where pin 70 is held in recess 15*a* of slot 15. When handle 20 is moved toward body 10 linkage 30 moves past a center position. If screw 91 is properly adjusted the over center action occurs as jaws 40 and 50 fit about a work piece. Optionally the features of the invention may be used to improve an automatic adjusting locking or non locking pliers. In this case screw 91 or other appropriate feature is replaced or supplemented with an auto sizing mechanism of known type. Body 10 is preferably elongated from upper jaw 50 toward a rear end of the body to provide a hand grip surface on the body.

Figure 12:
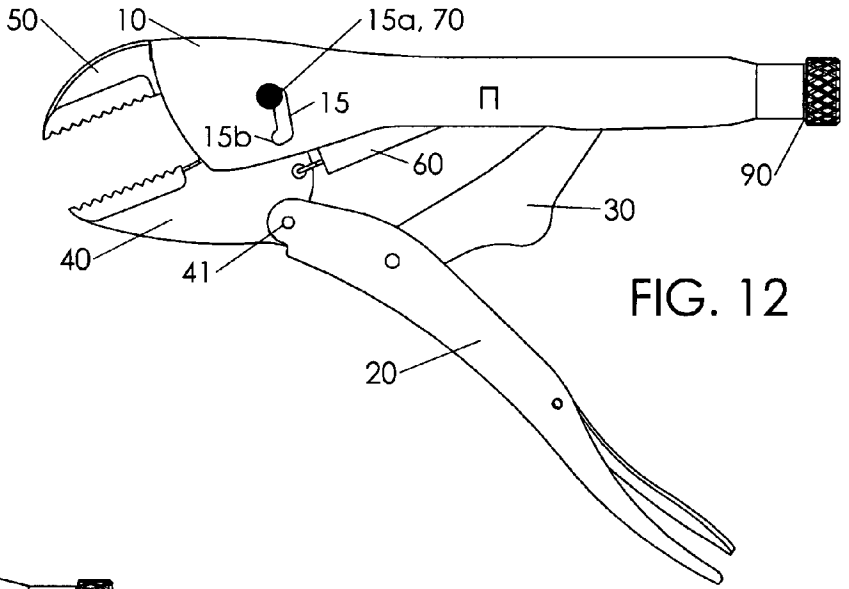
FIG. 12 is the pliers of FIG. 4 with the lever and lower jaw pivoted to an open position.
Figure 13:
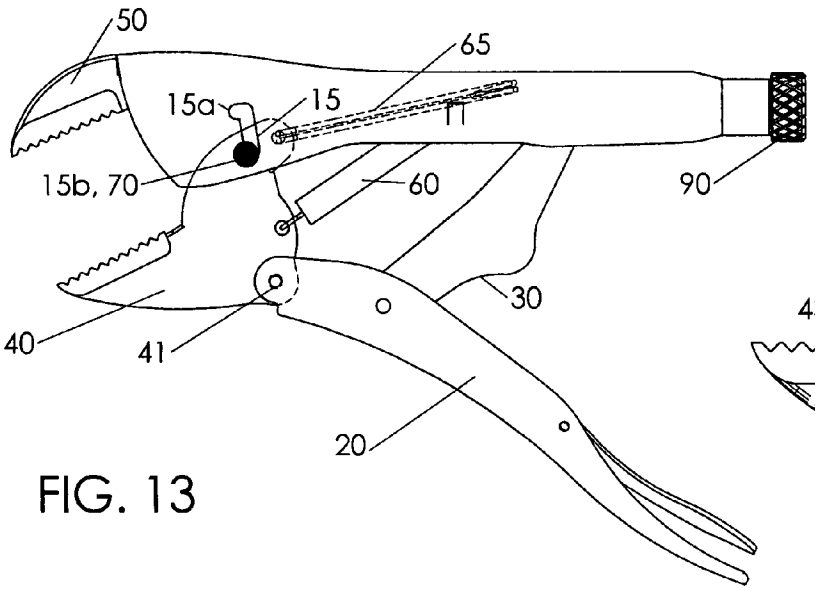
FIG. 13 is the pliers of FIG. 9 with the lever and lower jaw pivoted to an open position.

When handle 20 is moved away from body 10 the jaws move apart to an open position as or similar to that shown in FIGS. 12 and 13. The open position may be used to prepare the pliers to close about a work piece. Release lever 95 is optionally used to pry handle 20 away from linkage 30 to assist unlocking handle 20 from its over center locked engagement to link 30.

Figure 4:
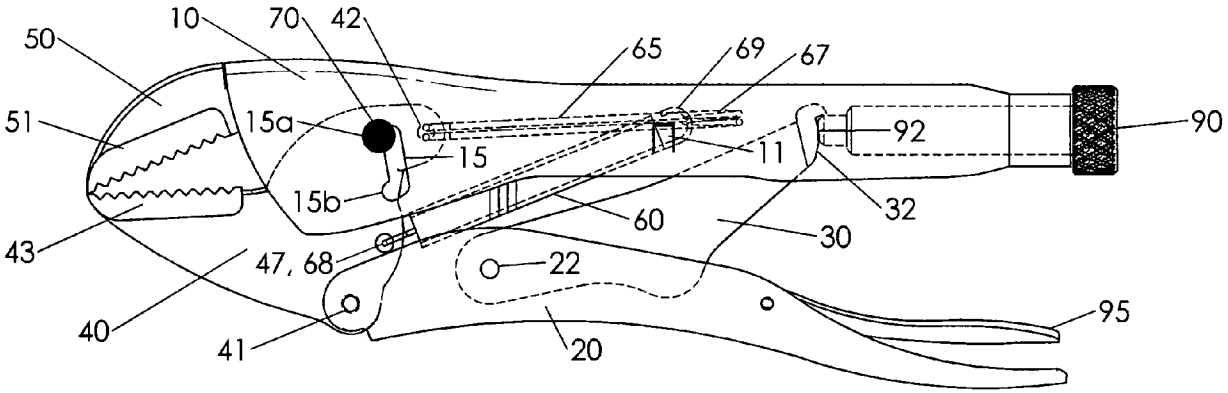
FIG. 4 is the pliers of FIG. 2 with internal components in hidden view.
Figure 9:
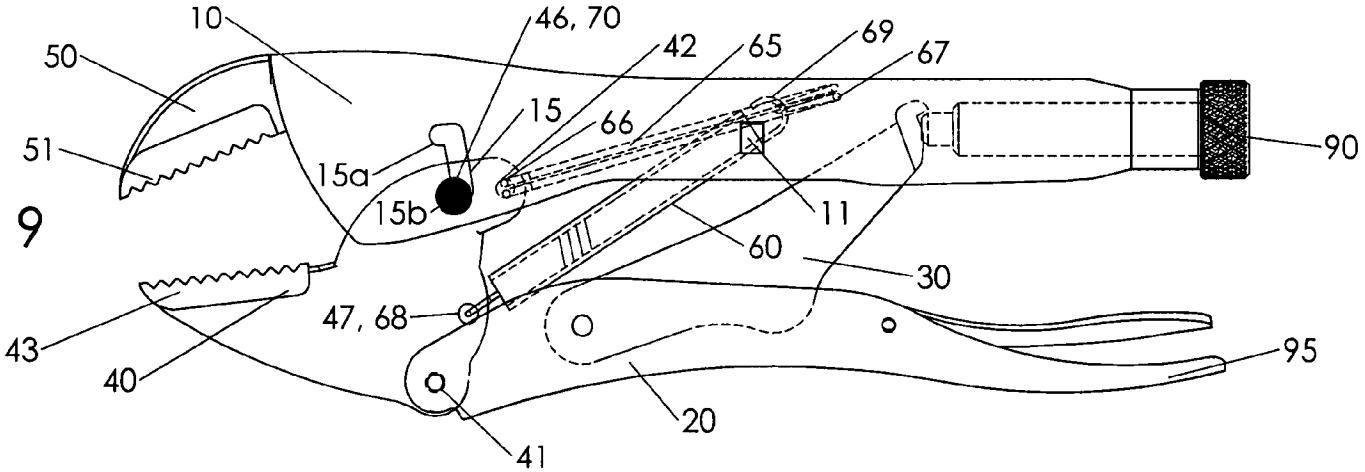
FIG. 9 is the pliers of FIG. 4 with the lower jaw translated to the large jaw size range and rotated to a minimum size jaw angle.
Figure 11:
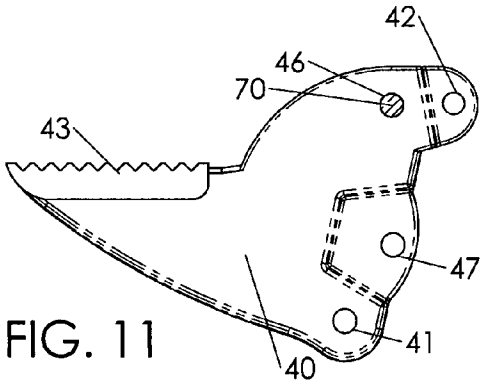
FIG. 11 is a side elevation of a lower jaw.

According to the invention the pliers include at least two distinct size ranges. This feature is readily apparent by comparing FIGS. 4 and 9. The jaws and handle 20 are in equivalent angular positions with pin 70 being moved. Spring 60 and wire link 65 follow lower jaw 40 to extend to a different angle. In FIG. 4 pin 70 is held on or in recess 15*a* of slot 15 and passes through hole 46, FIG. 11. In FIG. 9 pin 70 is moved down along slot 15 to recess 15*b*. Lower jaw 40 moves along with pin 70 to this lower position while normally maintaining substantially the same angular position to body 10 or jaw 50.

It is desirable to maintain a similar jaw angle between selected size ranges for a given position of screw 91. This helps the usage of the pliers to be more predictable and intuitive. As seen between FIGS. 4 and 9 the relative jaw angle is similar. To hold this angle there should be no motion that equates to adjusting the position of screw 91. Specifically the position of handle 20 should minimally translate horizontally relative to pin 70 as pin 70 moves vertically. As defined here vertical is about in the direction which the lower jaw moves between size ranges, or alternately about perpendicular to the upper jaw face. The relevant motion of handle 20 is controlled by the pivot location at screw tip 92 against linkage end 32 as pin 70 moves; as seen handle 20 moves slightly rearward about this arc center (tip 92) in FIG. 9. Therefore pin 70 should move about the same arc center so that the pin moves a similar distance rearward. The angle of slot 15 is oriented to provide this motion. In particular slot 15 is an approximate portion of an arc that has a center at tip 92.

Figure 8:
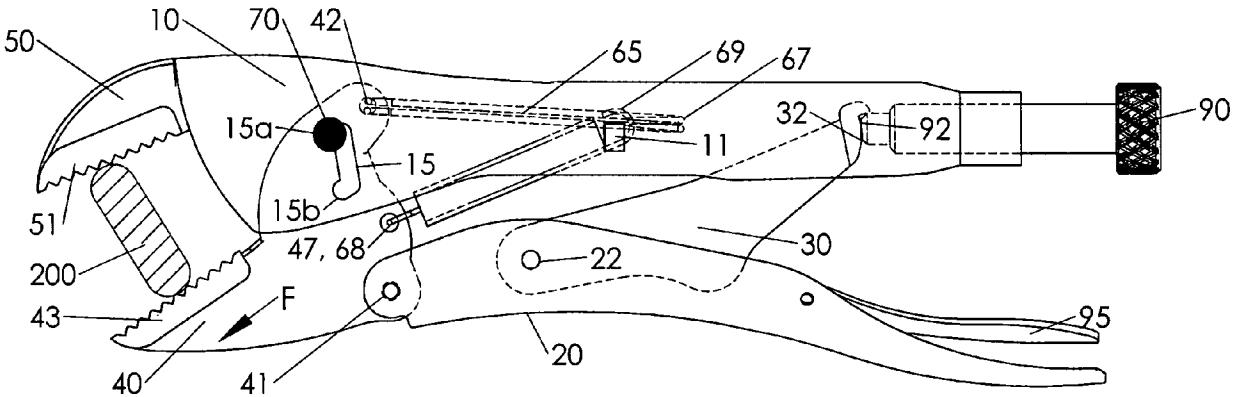
FIG. 8 is the pliers of FIG. 4 with the lower jaw pivoted to a larger jaw angle size.
Figure 10:
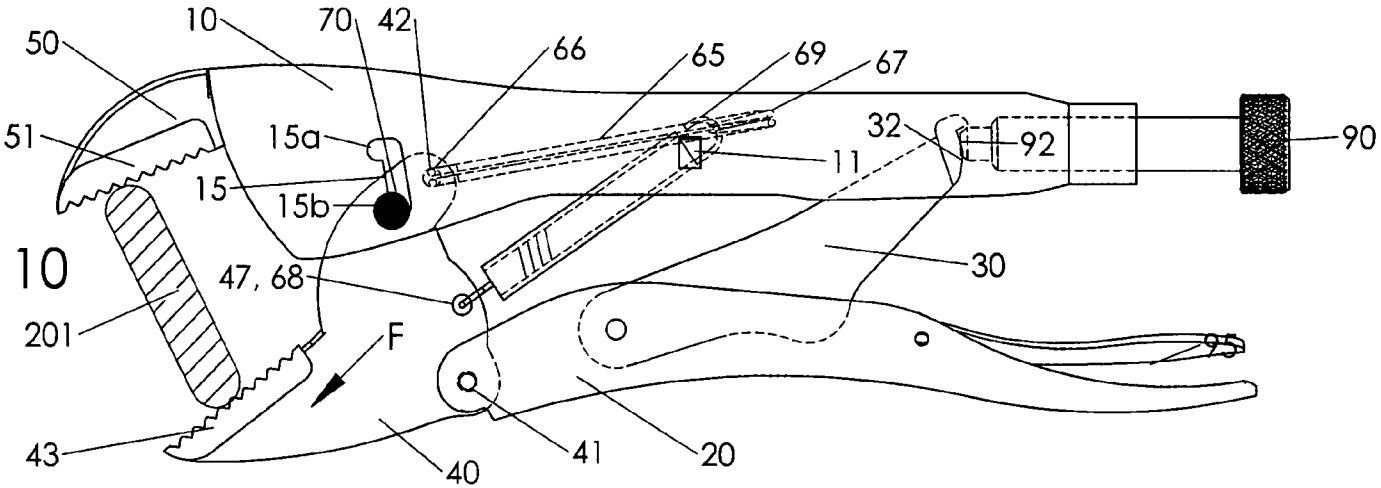
FIG. 10 is the pliers of FIG. 9 with the lower jaw rotated to a larger jaw angle to grip a work piece.

Recesses 15 and 15*b* preferably extend forward from slot 15 as shown. Preferably body 10 is of sheet metal form and slot 15 comprises two corresponding slots in opposed sides of the body. Pin 70 is biased into these recesses in a similar force direction both for loaded and unloaded conditions. Therefore pin 70 normally maintains a same position in a recess or equivalent structure as the pliers transition between loaded and unloaded conditions, for example as gripping force begins to bear upon a work piece. This constant pivot position helps to keep the jaw action simple and predictable. The loaded condition includes the jaws being pressed against each other either directly as in FIG. 1 or spaced and pressing a work piece 200, 201, FIGS. 8 and 10. The unloaded condition is normally when the jaws are spaced and no work piece is present although the jaws may be proximate as FIG. 1 and not pressing if screw 91 or equivalent structure is backed off slightly.

Figure 2:
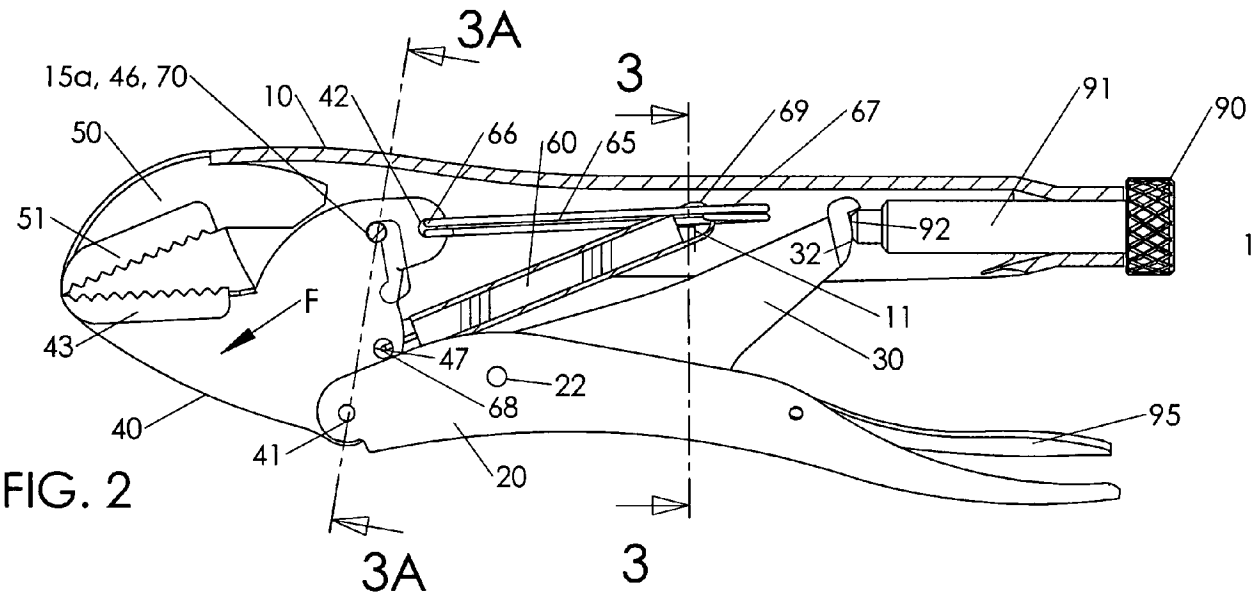
FIG. 2 is a side elevation view the pliers of FIG. 1 with a body in section to expose internal components.

In the loaded condition linkage 30 provides a forward force upon handle 20 at front link pivot 22. This force is relative to body 10 as screw 91 presses the link forward. At connection 41 handle 20 pivotally connects to lower jaw 40. Handle 20 transmits its forward force to lower jaw 40 at the connection. Therefore there is a net forward force upon lower jaw 40 relative to body 10. This forward or lateral detent force urges pin 70 into recess 15*a* or 15*b*. Pin 70 is attached to jaw 40 at hole 46, FIG. 11. At the same time in the loaded condition there is a downward force upon lower jaw 40 as it is pressed by upper jaw 50 or work piece 200, 201. This force urges pin 70 to press the bottom of recess 15*a* or 15*b*. These two forces combine to create a net force F, forward left and downward in the figures, on lower jaw 40, FIGS. 2, 8, and 10. This direction for force F causes pin 70 to press the lower left segment of recess 15*a* or 15*b*. The recess therefore need be only deep enough to provide an edge along its lower left portion to react to the direction of force F. The note 15*a* in FIG. 9 is pointing to this general location for recess 15*a*. For example there is no need in the preferred embodiment for a recess extending rearward from slot 15 since there is no force to counteract in that direction.

As just described for the jaw loaded condition the pliers assembly is inherently stable with respect to any selected position of pin 70. Force F is proportionate to the gripping force so the pliers are more stable as the gripping force of the jaws increases. As further described below the assembly is also stable when it is manipulated without a load. For example pin 70 remains in its selected position as handle 20 and screw 91 are moved and adjusted to position the jaws about a work piece. However pin 70 can readily be moved between selected positions when desired.

Figure 5:
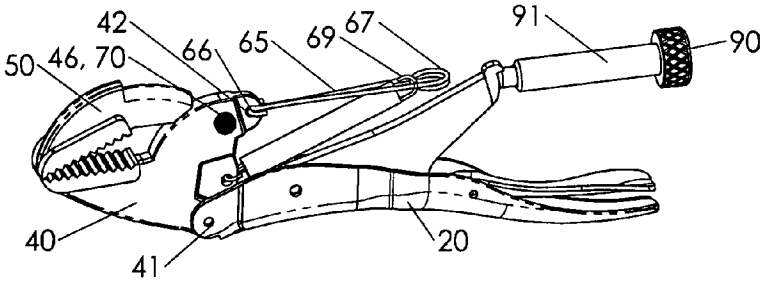
FIG. 5 is the pliers of FIG. 1 with the body not shown to expose internal components.

For the jaw unloaded condition the force from spring 60 is used to maintain a stable selected position for pin 70. Both a small size range and a large size range have a stable position for pin 70 in an unloaded condition. Spring 60 pulls rearward upon lower jaw 40 at spring hook 68 at a front end of the spring in opening 47. This force creates a firm bias to open lower jaw 40 and handle 20 as handle 20 is moved away from body 10. According to a preferred embodiment of the invention the rear end of spring 60, at hook 69, does not directly link to body 10 as is typical in prior locking pliers. Rather the immediate connection of hook 69 is to wire link 65, FIG. 7. Specifically the connection is to coil 67 or equivalent structure. See also FIGS. 2 and 5. Spring 60 and wire link 65 form at least in part a spring assembly. Opening 42 of lower jaw 40 pivotally fits hooks 66 or equivalent structure of wire link 65. Spring 60 thus creates a compressive force on the wire link to pull wire link 65 forward. This force causes a forward bias upon lower jaw 40 at opening 42. Opening 42 is preferably near to pin 70 relative to opening 47 so that a force at opening 42 may effectively act upon pin 70. Pin 70 is thus biased forward toward or upon the front side of slot 15 including within recesses 15*a* or 15*b*. Wire link 65 includes portions that are or may be in tension, for example the front portion of coil 67. However the overall force between ends of wire link 65 is compressive.

Figure 7:
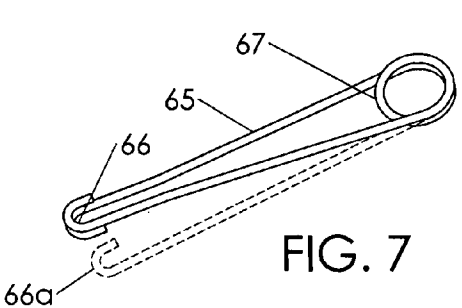
FIG. 7 is perspective view of a wire link.

Preferably wire link 65 includes a free position with the hook of one end in the open position 66*a*, FIG. 7. This will help in assembling the wire into opening 42 of the lower jaw. Once assembled the wire is held securely by the opening of the jaw with a light bias to remain in the closed condition of the solid lines in FIG. 7. The short legs of hook end 66 hold the hooks in position against lower jaw 40. No further components are needed to make the connection here, although such components may be used. With hook end 66 held in opening 42 wire link 65 is able to effectively push and pivot against the lower jaw to provide the forward bias on lower jaw 40 at opening 42. While wire link is preferably rigid with respect to its linking function it is flexible as illustrated with respect to its two arms. According to a further option described herein wire link 65 may comprise a spring or other second resilient member with respect to its linking function for example to supplement the action of spring 60.

Figure 3A:
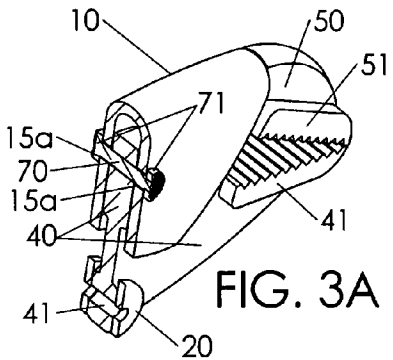
FIG. 3A is an isometric section view of the pliers of FIG. 2.
Figure 3:
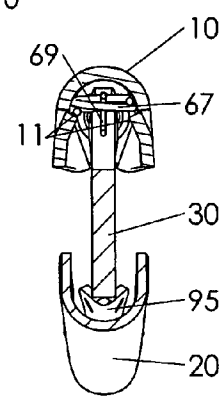
FIG. 3 is a sectional view of the pliers of FIG. 2.

The rear of wire link 65, along with spring hook 69, is slidably held in body 10 by tabs 11, FIGS. 3, 4 and 9. As illustrated the sliding is by the wire link, although it could be by or near hook 69. Tabs 11 or equivalent rib or other structure prevents the downward angle of spring 60 from pulling wire link 65 downward out of body 10. Hook 69 is thereby not connected to a fixed location of body 10, but rather is slidably or movably fitted to the body to provide a primarily longitudinal force to opening 42 through wire link 65. In this manner spring 60 pulls upon lower jaw 40 at opening 47 substantially indirectly, through wire link 65, rather than directly from a fixed location of body 10. The spring assembly of spring 60 and wire link 65 thus provides two distinct functions: a detent bias of pin 70 into a selected recess, and a firm rotational bias upon lower jaw 40 away from upper jaw 50. This rotational bias in turn biases handle 20 toward its open position. Preferably wire link is substantially horizontal or longitudinal within body 10 to provide an efficient rearward bias in a compact shape to its linked location on lower jaw 40.

Optionally further arms, springs, or other members may hold wire link 65 in position relative to body 10. For example if components beyond tabs 11 are configured or added to cause an upward bias upon the rear of wire link 65 then tabs 11 will not be required. In another alternate embodiment, not shown, a second spring may push upon lower jaw 40 at or near opening 42 or equivalent location. This second spring may replace or supplement wire link 65 to form the spring assembly with spring 60. Then one or both springs may attach to a fixed location of body 10, for example near to tab 11. The function will normally be equivalent to the use of rigid wire link 65 with a possible trade off in complexity. A further option below includes a torsion spring.

As just described for the unloaded condition lower jaw 40 is pulled rearward at its bottom and pushed forward at its top to create a torque on the lower jaw. The pulling is at opening 47 and the pushing at opening 42. These respective locations are substantially spaced apart from each other to create a firm rotational torque on lower jaw 40 relative to handle 20. Specifically lower jaw 40 is biased to rotate counter clockwise away from upper jaw 50 about connection 41 in the views. Pin 70 is held in hole 46 of the jaw. Therefore pin 70 is pressed forward in slot 15; see FIG. 9 for a clear view of this condition. Further lower jaw 40 is firmly biased toward its pivoted open position for any pivoted position of the lower jaw and for both positions of pin 70 in recess 15*a* or 15*b*. The rotational bias may be considered in relation to handle 20 but need not be exclusively about this reference.

A firm rotational bias according to the invention is sufficient to cause handle 20 to reliably move against a predetermined force for a substantial majority of the possible motion of the handle in an unloaded condition. A further way to consider a firm torque is that which is sufficient to hold the handle in an open position against a predetermined force. Such a predetermined force may be the weight of handle 20 and its linked elements. For example if the views of FIGS. 12 and 13 are reversed to be upside down, not shown, then handle 20 will be biased by its own weight to close against body 10. The firm force from the spring assembly maintains handle 20 opened or moves handle 20 upward away from body 10 toward the open position in the upside down position of the pliers. With this firm force the pliers gently expands within a user's grip so that the user can keep the pliers steady in a hand. In contrast empirical experience shows that a limp or weakly biased handle will tend to fall out of an operator's hand as the handle collapses inward thereby requiring two hands to operate.

Alternately the firm rotation bias may be indirectly applied to the lower jaw. For example the bias may be directly upon the handle by a further spring connecting the handle to the jaw, the body or other element of the pliers, not shown. For example a torsion spring may be fitted at the pivot of opening 41 to bias lower jaw 40 and handle 20 toward the respective open positions. In this example the lower jaw is biased to rotate by way of the handle at opening 41.

Through the rotational bias or equivalent force pin 70 is pressed into the recess by a force in relation to handle 20. As discussed above handle 20 may be pressed forward in relation to body 10 through link 30, so pin 70 is pressed into the recess by a force also in relation to body 10. The unloaded force upon pin 70 from spring 60 is in a similar direction to loaded force F discussed above and in fact is normally additive to the force F, although of lesser magnitude. Therefore the applied force upon pin 70 holds the pin without shifting or otherwise substantially moving the pin in a selected recess through a transition between loaded and unloaded conditions.

It is desirable that lower jaw 40 be firmly biased to move toward its pivoted open position for any condition of the pliers other than locked as discussed above. This pivoting bias is preferably relatively constant for all rotational jaw positions, although the resulting bias on handle 20 will be non-linear because of the varying force inherent in the over-center connection to the handle. Specifically the force moving handle 20 away from body 10 will be less as link end 32, link pivot 22, and opening 42 are near aligned in the on-center or locked condition of these elements. In the respective aligned positions of FIG. 2 or 8 the force to move handle 20 will be near zero since link 30 is at or near its locked condition. In FIGS. 12 and 13 link 30 is well into its unlocked position and handle 20 will have the firm opening bias whereby a torque on lower jaw 40 can readily cause handle 20 to pivot open. The locked condition may occur both with the jaws loaded to grip a work piece or unloaded; the locked or unlocked condition refers to the relative alignment of link 30 discussed here.

Comparing FIGS. 9 and 13 is it seen that spring 60 pulls on jaw 40 at a vertically spaced distance in FIG. 9. This distance is preserved in FIG. 13. Therefore a firm pivoting bias is maintained on lower jaw 40 through its full normal pivoting range. Such opening bias transmits to handle 20 to bias or spread the handle away from body 10. In normal use a user holds the pliers against this opening bias as the jaws are positioned about a work piece. If there is no or minimal opening bias upon the jaw then it is difficult to operate the pliers by one hand. For example a work piece may be half inch in size. Then a user would select a suitable size range for pin 70 and setting for screw 91. In a large pliers of 10" length for example recess 15*a* would be appropriate. The user would then hold the body 10 and handle 20 so that the jaws are open to a pre-position just greater than ½". Then the jaws are squeezed to clamp the work piece. As long as there is enough spreading force from the spring action the pliers will be easy to grip and control. A user will have feedback for the position of the handle as the handle presses the gripping hand. The jaws can be opened as required with one hand while the pliers will not fall out of the hand. Also there is no need for a second hand to guide the handle to pull it to the suitable pre-position.

As discussed above the respective pushing and pulling forces are spaced apart. Opening 42 is biased forward near to pin 70 in all size range positions, compare FIGS. 4 and 9. At the same time opening 41 is pulled rearward in all positions. So the first force application location, opening 47, is substantially further from pin 70 than the second force application location, opening 42. By placing opening 42 nearly aligned vertically with pin 70 the pliers remains compact; see FIG. 8 wherein a more distant spacing of opening 42 would force body 10 to bulge upward near opening 42. In particular if force at opening 42 were substantially or exclusively used to bias lower jaw 4 to pivot open then opening 42 would need to be much higher in position. To illustrate this issue see FIG. 4. Wire link 65 is right behind pin 70 and cannot provide an opening pivot bias to the lower jaw. But in order to maintain a compact body that allows the jaw position of FIG. 8 opening 42 should not be located higher where it could provide a light albeit still inadequate rotating bias. Wire link 65, or equivalent spring biased element, cannot by itself bias the jaw to rotate firmly through its various possible positions According to the invention there is a distant second spring bias location below, at opening 41, to create the firm jaw opening bias discussed earlier wherein opening 42 is substantially distant from pin 70 relative to the distance of opening 42 from pin 70.

Figure 14:
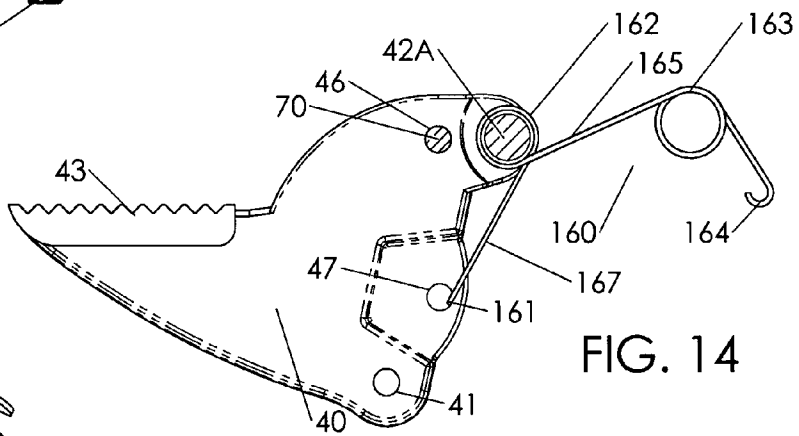
FIG. 14 is a lower jaw with an alternate embodiment biasing spring.

In the preferred illustrated embodiment wire link 65 or equivalent structure is an elongated narrow element that is co-extensive with the interior of body 10. An alternate embodiment biasing spring is shown in FIG. 14. A first coil 162 of torsion spring 160 fits about to pin 42A of lower jaw 40. Proximal end 161 of the torsion spring presses against lower jaw 40 to cause the jaw to rotate counterclockwise from the torque of first coil 162 in FIG. 14. End 161 is or includes an extension of coil 162 to rotationally fix arm 167 or a segment of coil 162 to lower jaw 40 whereby coil 162 can transmit torque to the jaw. In the case that end 161 is fixed to the jaw there will be some deflection along arm 167 so that coil 162 is not rigidly fixed to the jaw, however it will be functionally fixed to the jaw. In FIG. 14 this extension is preferably a bent segment of arm 167, not shown, that extends into the page through opening 47. This is toward the jaw open direction in the assembly of the pliers. The distal end of the spring extends to or comprises a resilient element, such as second coil 163. The bias from the second coil or resilient element biases lower jaw 40 forward at pin 42A to engage the recesses as discussed elsewhere herein. According to this function hook 164 is pivotally attached to body 10, not shown, whereby lower jaw 40 is biased away from hook 164 and its mount in the body. Torsion spring 160 thereby operates upon two spaced locations of lower jaw 40, pin 42A for the detent bias, and end 161 for the rotation bias. It is not required that end 161 be specifically below coil 162 as shown. Optionally the end may press closer to coil 162, including above the coil. But this pressing location will still be spaced from the center of force from the detent bias, which is the center of pin 42A in the illustrated view. Such spacing is required to create a usefully firm torque or rotational bias on the lower jaw. To remain compact the torque biasing coil 162 shall be proximate to or concentric with pin 70 whereby it can act directly to rotate the jaw. Preferably coil 162 is relatively fixed to lower jaw 40 such that a center of the coil does not substantially move in relation to the jaw as the jaw moves through its possible positions. In this way the coil can most directly apply rotational torque to the jaw while remote coil 163 or other spring element biases coil 162 laterally.

According to this alternate embodiment lower jaw 40 may be provided both an opening and a forward bias by a single spring element. No further link is required. This contrasts with a biasing spring known in the art wherein a torsion spring includes only a single coil remote from the lower jaw and can provide only a forward bias on a single location of the lower jaw. As a result the prior jaw and handle are limp with no opening bias upon the handle. In a further option a compression or extension spring, not shown, may be fitted to or extend along arm 165 to provide the forward bias. As illustrated the first coil 162 is mounted near a separate pin or equivalent structure spaced from pivot pin 70. This allows the torsion coil to be fitted at a narrow extension of lower jaw 40 whereby the pliers can remain slim at the area of pivot pin 70. Optionally coil 162 may be fitted at or around pin 70.

In the preferred or alternate embodiment biasing spring designs a spring, combination of springs, or operative rigid links to the springs may be described as a spring assembly. The spring assembly provides a dual force action to the lower jaw. This force comprises both a forward bias at the pivot pin and a torque to the lower jaw. To benefit from the advantage of the invention the torque must be high enough to create the firm opening bias to the handle of predetermined force discussed above.

As illustrated the front side of slot 15 includes recess 15*a* and 15*b*. The spring bias upon pin 70 described here is a primary positioning force for any unloaded condition of the pliers. For example it operates in FIG. 9, 12 or 13. The bias also operates in loaded conditions such as FIG. 1, 8 or 10. The bias from the loaded condition of gripping the work piece will normally be substantially greater than that from spring 60; the force F discussed earlier will be proportionate to the gripping force and will be a primary force in pin 70 when loaded. In either loaded or unloaded case pin 70 is held to be stable in recess 15*a* or 15*b* and pin 70 does not normally translate relative to the slot or body 10 as the condition transitions between loaded and unloaded.

Figure 6:
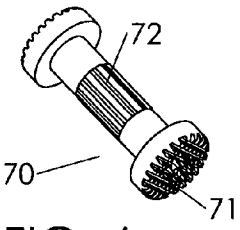
FIG. 6 is a perspective view of a pivot pin.

To select a position for pin 70 in slot 15, and a resulting size range for the pliers, the pin may be moved directly by a user's fingers. Enlarged head 71, FIGS. 3A and 6, is preferably textured or otherwise suitable for gripping by a user to slide the pin along slot 15. The diameter of head 71 is preferably substantially larger than the diameter of a central portion of pin 70; a central portion for example being the area 70 shown in FIG. 2 or 11. A typical position from which to select an opening size range is shown in FIGS. 12 and 13. The jaws are unloaded with handle 20 optionally moved at least partly away from body 10. To move to the larger size range pin 70 is urged rearward, against the bias from spring 60 or equivalent spring, from its position in recess 15*a* of FIG. 12. As illustrated the spring bias is the primary or only force to be overcome to move pin 70 out from the recess. The pin is then slid downward in slot 15 until it snaps or moves into recess 15*b* of FIG. 13. As discussed above the pin is normally biased to move fully or substantially into recess 15*b*. This process is reversed to select the smaller size range. According to the invention pin 70 is normally translated between selected positions of slot 15. The pin is readily accessed directly but need not be rotated, pressed or manipulated in any additional manner. If for any reason the pin is nearly but not fully seated into a selected recess when unloaded the pin will become fully seated when loaded as force F, FIG. 2 for example, increases.

When moved rearward out of a recess pin 70 will normally be biased to slide along a front side of slot 15 to move toward the upper recess, recess 15*a* in the instant example. This is a result of the angle of spring 60 relative to slot 15 or body 10 wherein the spring pulls upward on lower jaw 40. This creates a default position of the small or "normal" size range of FIG. 12. This may be convenient since the familiar size range is a good starting condition for a use session. However as discussed earlier the larger size range of FIG. 13, wherein pin 70 is in recess 15*b*, is a stable condition that will remain so unless the pin is intentionally moved out of recess 15*b* and allowed to move to the upper position. Therefore upon operating pin 70 the pin will normally move upward toward the small jaw size range but can easily be urged downward to the lower position to engage recess 15*b*. In all cases the position of pin 70 is stable in either of recess 15*a* or recess 15*b*.

It is possible that the pliers may be accidentally dropped. If this occurs in the unloaded condition of FIG. 13 the impact may cause pin 70 to move upward into recess 15*a*, FIG. 12 as a result of the upward bias discussed above. A user would then restore the pliers to the larger size range if that is still desired. However pin 70 remains stable in a selected recess for any normal adjusting or operating action in the unloaded condition. For example in the loaded condition handle 20 is not normally moved; in a locking pliers embodiment it is not freely movable with respect to body 10 since it is held in the over-center position. However in the unloaded condition handle 20 is normally freely movable for example between the positions of FIG. 9 and FIG. 13. Such handle motion is a normal adjusting or operating action when unloaded. Pin 70 remains stable in either of selected recess 15*a* or 15*b*, or further optional recesses or equivalent structures, as handle 20 is so moved or left open and not held at all. For example pin 70 will remain stable in any selected recess through a full motion, or a substantial portion of a full motion, of handle 20 from fully open to fully closed and locked as shown for example from FIG. 13 to FIG. 9 or FIG. 12 to FIG. 4. The selected size range is thereby predictable and reproducible whether a user is using the pliers or not.

Optionally as described later herein a secondary action may be added to pin 70 or equivalent structure to positively lock it in position, although such secondary feature is not required. When loaded as described earlier pin 70 is held very securely wherein force F is a primary feature. In the loaded case the pliers will be more resistant from moving out of any recess of slot 15 when dropped or impacted.

Optionally spring 60 may be configured to minimize or remove the default position bias, or to make the larger size range a default position. For example spring 60 may be mounted at a different angle or further arms or springs may be linked to lower jaw 40 or other components, not shown. Then, for example, pin 70 will have no bias to move vertically along slot 15. Or the pin may be biased to move toward lower recess 15*b*.

In FIG. 6 pin 70 is shown with an enlarged head 71 at each end. The inside face of these heads is normally spaced slightly away from an outer surface of body 10 to allow free motion of the pin relative to body 10. However this inside face is preferably immediately adjacent to the outer surface to provide a most compact width to the pliers at the pin. The heads may slide against an outer surface of body 10 around slot 15 to help position lower jaw 40 within body 10 in this area. In FIG. 6 pin 70 includes splines 72. These splines or equivalent structures may optionally hold pin 70 securely in hole 46 so that the pin cannot rotate or slide axially in hole 46. This may help in gripping head end 71 as the user operates pin 70 since the pin will not spin and will hold a more predicable position. It also may have an advantage to communicate the proper function of the pin; in particular that the pin operates by simple sliding and not by rotating, spinning or depressing. According to the invention the pin extends past a surface of body 10 to be readily accessed. This extension is in the apparent in FIGS. 3A and 6 where the head end is a thick structure; out of the page in the elevation views. A smaller diameter but still thick head end may be used. As a result of this structure the pin is in the form of a slid-able button or slide switch. Preferably the button is pressed from two sides of body 10 as is apparent in FIG. 3A, where sides are the faces into or out of the page in the elevation views. Lower jaw 40 is normally moved along slot 15 by gripping the body and squeezing the pin head areas rather than gripping the jaw or any other element of the pliers. Pin 70, at head ends 71 moves in relation to body 10 on both sides of the body; the button on FIG. 3A slides along both sides of body 10. In this manner the position of the button of pin 70 can be accurately controlled in relation to the body and to slot 15.

Pin 70 may be initially formed with a single head. The opposing head may be in the form of a washer that is riveted or swaged against a shoulder, not shown, of the opposed small pin end after assembly to the pliers. Or the opposed head may be entirely formed from the small end by a riveting operation. An advantage of the washer structure is that the shoulder defines a relatively precise position for the second head. Then the pin can be fitted about body 10 with the slight spacing of the head inside faces while ensuring that the pin will not bind upon body 10. Optionally pin 70 is a direct extension of lower jaw 40 wherein there may be no explicit separate pin 70 nor hole 46 into which the pin is fitted. Optionally pin 70 may have a minimal head.

A further method of selecting a size range provides that a user moves lower jaw 40 directly rather than by pin 70 to cause pin 70 to translate in slot 15 or equivalent structure. However this may be less intuitive since it is more common to operate a button type structure, i.e. the head of pin 70, and further when lower jaw 40 is near to upper jaw 50 it will be difficult to grasp the lower jaw to manipulate it. The spring assembly is resilient such that the rotational bias is firm while the detent bias may be light. The dual action spring assembly efficiently separates the two functions so that for example a very high detent force is not required to generate a firm rotation bias. In the preferred embodiment the pushing and pulling force application locations are spaced well apart so that a firm pulling at opening 47 to create the rotating bias does not affect the pushing bias at opening 42. Alternately a torsion spring proximate to pin 70 creates an independent rotational bias, whereby the torsion spring is biased forward by a further element of the spring assembly. With a preferably light detent bias the slide switch created at head 71 is operable by a single finger on a single side of the body 10. Thus the size range may be readily selected by a same single hand that holds the pliers. Optionally both head ends of pin 70 may be operated.

The simple structure of pin 70 requires no secondary elements to move pin 70 to, or hold the pin in, a selected recess or equivalent stable location of body 10. Therefore no such elements need be actuated to enable moving lower jaw 40. With no need for such additional elements or motions pin 70 normally remains in a constant position and orientation relative to lower jaw 40 as the pin moves along with the jaw as the size range is adjusted. However if desired secondary motions of pin 70 or associated elements relative to lower jaw 40 may be enabled, for example, as a supplemental locking structure or other reasons. Further lower jaw 40 need not be rotated for the purpose of size selection.

As illustrated there are two recesses in slot 15. Optionally more than two may be included. The recesses are preferably rounded or smooth as shown. Optionally they may include flats with a pointed inside corner for example in the form of a notch in the front of slot 15. Further there may be a recess or notch in a rear of slot 15 to correspond or supplement the front recesses shown. In a further embodiment pin 70 may be oblong, D shaped in section, or other non-round shape and be rotatable. Then the pin may include a further operating mode, not shown, that rotates the pin between a secure mode in a recess and a movable mode that allows the pin to slide between recesses. Or the pin may be or include an element that is movable axially. These secondarily movable pins may engage only a front recess or both a front and rear recess. Such structures may be desired for example to make changes in size range less convenient or to more positively hold a selected size range. However as discussed earlier the pliers in the illustrated embodiment is normally stable in both unloaded and loaded conditions.

It is a feature of the invention that the headed version of pin 70 illustrated is of a familiar appearance being minimally or no larger than a rivet in a similar location of a conventional one-sized device. Pin 70 may be compact because it does not require any secondary function. For example pin 70 does not need to be depressed, moved axially, or rotated to release jaw 40 to move to another size range. Rather pin 70 is stable in a selected position through the further structures described herein.

In the present invention a pliers is improved at minimal cost. In the preferred embodiment only a simple wire form, wire link 65, need be added. A second optional component is the washer head discussed for pin 70. Prior size range adjusting locking or similar pliers required complex or bulky assemblies to provide the adjusting function or were difficult to operate. The simplicity of the inventive structure includes a novel linkage between a spring and a lower jaw. The components of the pliers may be manufactured in a same manner as known pliers so that there is no additional cost to such components. For example lower jaw 40 and body 10 have no added complexity over conventional respective parts. This simple structure provides a novel function in a familiar, compact and intuitive pliers device.

According to the invention a selected size range is held as a stable condition for both loaded and unloaded states. In particular, in the preferred embodiment unloaded state, a pivot pin such as pin 70 includes a button type feature and moves to or from a selected size range with no secondary actions upon or by the pin. For example the pin may be rigidly attached to lower jaw 40 where the pin moves directly with the jaw and is directly operated upon by a user in an action similar to moving a slide switch. Optionally the pin may rotate within an opening of the jaw but need not require such rotation to allow jaw 40 to move to a different size range. To maintain a stable selected size range a spring, spring element or resilient element biases pin 70 and/or jaw 40 into a detent or equivalent engagement to slot 15 or equivalent structure. For example as pin 70 slides along slot 15 the pin will snap forward into a selected recess from the bias force of spring 60 when the pin becomes aligned with the recess. In a preferred embodiment the spring forces are spaced apart on the lower jaw to maintain a firm opening bias upon the lower jaw for all freely movable positions of the pliers. For example the spring as able to firmly pivot the lower jaw from its closed, unloaded, position to its most open position for any selected size range.

In contrast to the present invention prior auto adjusting pliers have required the pin, an attached handle, or a further lever, to be rotated or translated to enable moving between size ranges. Or a pin required an axial pressing motion for such movement. In certain prior auto-adjusting pliers an unloaded condition is unstable in at least one direction. For example a lower jaw maybe biased to remain in a maximum position of a size range but still be immediately and unpredictably movable toward a smaller position with only the spring bias and incidental friction resisting this upward motion. In other prior locking pliers a detent biasing spring can provide only that single function, where the lower jaw and handle are limp in all unloaded positions. According to the present invention a single spring can hold the jaws to a selected size range in a predictable and repeatable manner including for example either a small or a large size range. The same spring may provide the further functions required to facilitate operating as a locking or similar pliers once the size range is selected, including the function of providing a firm opening bias to the handle through most possible handle positions. The opening bias may be through the lower jaw as illustrated or directly upon the handle by a further spring connecting the handle to the jaw or the body, not shown. To adjust the jaw the jaw or an attached pin is moved directly by a user to the selected position without secondary rotation or other actions. The lower jaw may maintain a constant angle relative to the upper jaw as the position of pin 70 is moved to a selected size range.

While particular forms of the invention have been described and illustrated, it will be apparent to those skilled in the art that various modifications can be made without departing form the spirit and scope of the invention. Accordingly, it is not intended that the invention be limited except by the appended claims.

The invention claimed is:

1. A pliers for gripping a work piece comprising:

an elongated body;

an upper jaw at a front of the body;

a lower jaw pivotally attached to the body at a pivot pin;

a handle linked to the lower jaw wherein moving the handle in relation to the body causes the lower jaw to pivot in relation to the upper jaw;

an over-center linkage pivotally attached between the handle and the body to lock the lower jaw against the upper jaw with a gripping force in a loaded condition of the pliers;

a pivot pin attached to the lower jaw;

a slot in the body;

the pivot pin movable between a first and a second location of the body within the slot, the first and second locations of the body corresponding to respective recesses of the slot, a first recess corresponding to a small jaw size range and a second recess corresponding to a large jaw size range, the recesses being in a front side of the slot;

the over-center linkage presses the lower jaw forward, and the pivot pin into a selected recess, with a force that is proportionate to the gripping force in the loaded condition;

a spring element biasing a first force application location of the lower jaw;

a spring link of a spring assembly extending from a second force application location of the lower jaw near the pivot pin, the spring link connected within the spring element whereby the spring link presses the lower jaw forward at the second force application location of the jaw, the spring link and spring element forming a spring assembly;

the first force application location is substantially further from the pivot pin than the second force application location is from the pivot pin whereby the lower jaw is firmly biased by the spring assembly to pivot away from the upper jaw in an unloaded condition of the pliers; and, the pivot pin biased into a selected recess in the unloaded condition of the pliers by a force from the spring element through the spring link, the pivot pin being stable within any selected operative recess whereby the selected size range is maintained in the unloaded condition as the handle is moved.

2. The pliers of claim 1 wherein the handle is firmly biased by the spring assembly to move away from the body against a weight of the handle in an unlocked condition of the pliers.

3. The pliers of claim 1 wherein the pin includes a button structure forming a slide switch with an enlarged head end that extends past a side surface of the body, the head end being substantially larger than a diameter of a central portion of the pin, and an inside face of the enlarged head end faces the side surface and is movable along the slot immediately adjacent to the side surface of the body.

4. The pliers of claim 3 wherein the slide switch is operable by a single finger of a hand.

5. The pliers of claim 1 wherein the link is a substantially rigid element, the link is slidably confined within the body, and the link is pivotally attached to a rear end of the spring element.

6. The pliers of claim 5 wherein the link is a wire form with a coil at a rear end, and the rear end of the spring element is hooked to the coil to pull upon the wire link.

7. The pliers of claim 5 wherein the link is a wire form with a hook at a front end, and the hook is pivotally held in an opening of the lower jaw at the second location of the lower jaw.

8. The pliers of claim 1 wherein the pivot pin includes a head end, and a user normally moves the pivot pin along the slot by directly grasping the head end, and an angle between the upper and the lower jaw normally remains unchanged as the size range is changed.

9. The pliers of claim 1 wherein the second force application location is substantially vertically aligned with the pivot pin and the lower jaw is biased to rotate substantially at the first force application location below the pivot pin.

10. The pliers of claim 1 wherein, in the unloaded condition, a single spring provides the bias to both the first force application location and the second force application location.

11. The pliers of claim 10 wherein the spring provides a bias to move the pivot pin into the selected recess in a detent engagement.

12. The pliers of claim 1 wherein a force on the pivot pin is in a similar direction for both loaded and unloaded conditions, and the pivot pin maintains a substantially same position of the body as the pliers transitions between the loaded and the unloaded conditions.

13. A pliers for gripping a work piece comprising:

a body;

an upper jaw at a front of the body;

a lower jaw pivotally attached to the body at a pivot pin;

a handle linked to the lower jaw wherein moving the handle in relation to the body causes the lower jaw to pivot in relation to the upper jaw;

a first spring element biasing a first force application location of the lower jaw to cause the lower jaw to pivot with respect to the upper jaw;

a further spring element causing a lateral detent force on the lower jaw at a second force application location of the lower jaw spaced from the first force application location of the jaw;

the pivot pin movable between a first and a second location of the body within a slot of the body, the first and second locations of the body corresponding to respective recesses of the slot, a first recess corresponding to a small jaw size range and a second recess corresponding to a large jaw size range, and the further spring element biasing the pivot pin to be stable within any selected operative recess of the slot in each of a loaded and an unloaded condition of the pliers through a substantial portion of a full motion of the handle from fully open to fully closed.

14. The pliers of claim 13 wherein the pivot pin includes a button structure of an enlarged head end that extends past a side surface of the body, the button is operable as a slide switch to select a size range, the pin is exposed and operable from two opposed sides of the body where the exposed end of the pin moves in relation to each side of the body, and an inside face of the enlarged head end moves along the slot immediately adjacent to the side of the body.

15. The pliers of claim 13 wherein the first spring element is a coil of a torsion spring, the coil is proximate the pivot pin, the coil includes an extension to rotationally fix a segment of the coil to the lower jaw, and the further spring element is connected to the jaw to bias the jaw laterally.

16. The pliers of claim 13 wherein the first spring element is a front end of a spring, and the further spring element is a rear end of a same spring, the spring extending rearward from the lower jaw.

17. The pliers of claim 16 wherein the front of the spring pulls rearward at the first force application location of the lower jaw, the rear of the spring is connected to an elongated link, the elongated link is pivotally connected to the second force application location of the lower jaw, the second force application location is above the first force application location, and the second force application location of the lower jaw is biased forward in relation to the body.

18. The pliers of claim 17 wherein the rear end of the spring is movably connected to the body at a non-fixed location of the body.

19. The pliers of claim 15 wherein the coil remains substantially stationary relative to the lower jaw as the lower jaw moves through its possible positions.

20. A pliers for gripping a work piece comprising:

an elongated body;

an upper jaw at a front of the body;

a lower jaw pivotally attached to the body at a pivot pin, the pivot pin attached to the lower jaw;

a handle linked to the lower jaw wherein moving the handle in relation to the body causes the lower jaw to pivot in relation to the upper jaw;

an over-center linkage pivotally attached between the handle and the body to lock the lower jaw against the upper jaw with a gripping force in a loaded condition of the pliers;

a slot in the body;

the pivot pin movable substantially vertically between a first and a second location of the body within the slot, the first and second locations of the body corresponding to respective recesses of the slot, a first recess corresponding to a small jaw size range and a second recess corresponding to a large jaw size range, the recesses being in a front side of the slot;

the over-center linkage presses the lower jaw forward, and the pivot pin into a selected recess, with a force that is proportionate to the gripping force in the loaded condition;

a spring biasing a first force application location of the lower jaw rearward to cause the lower jaw to be biased to pivot away from the upper jaw in an unloaded condition of the pliers;

a link extending from a second force application location of the lower jaw near the pivot pin, the link connected to a rear end of the spring whereby the link presses the lower jaw forward at the second force application location of the jaw;

the second force application location being nearer to the pivot pin than to the first force application location;

the pivot pin biased forward within the slot whereby the pivot pin will move into a selected recess with a detent engagement from the bias of the spring as the pivot pin slides along the slot into alignment with a recess; and the pivot pin biased into the selected recess in the unloaded condition of the pliers by a force from the spring through the link, the pivot pin being stable within any selected operative recess whereby the selected size range is maintained in the unloaded condition as the handle is moved.

21. The pliers of claim 20 wherein the spring extends rearward from the lower jaw, the link is substantially rigid in a horizontal direction within the body, and the spring creates a compressive force upon the link to push the second force application location of the lower jaw forward.

22. The pliers of claim 20 wherein the link is a wire form including a coil at a rear end, and the spring hooks to the coil.

23. The pliers of claim 20 wherein the link is slidably held to the body, and the spring is movably held to the body near a rear of the link.

24. The pliers of claim 22 wherein the spring is movably attached to the body through the link.

25. The pliers of claim 20 wherein a force on the pivot pin is in a similar direction for both loaded and unloaded conditions, and the pin maintains a substantially same position of the body as the pliers transitions between the loaded and the unloaded conditions.

* * * * *